US011795594B2

(12) United States Patent
Azuma et al.

(10) Patent No.: US 11,795,594 B2
(45) Date of Patent: Oct. 24, 2023

(54) THREAD TAKE-UP LEVER SWITCHING MECHANISM AND SEWING MACHINE

(71) Applicant: JANOME Corporation, Hachioji (JP)

(72) Inventors: Toyohiro Azuma, Hachioji (JP); Ushio Yokoyama, Hachioji (JP)

(73) Assignee: JANOME Corporation, Tokyo (JP)

( * ) Notice: Subject to any disclaimer, the term of this patent is extended or adjusted under 35 U.S.C. 154(b) by 0 days.

(21) Appl. No.: 17/709,415

(22) Filed: Mar. 31, 2022

(65) Prior Publication Data

US 2022/0364287 A1 Nov. 17, 2022

(30) Foreign Application Priority Data

May 13, 2021 (JP) ..... 2021-081899

(51) Int. Cl.
*D05B 49/02* (2006.01)
*D05B 49/04* (2006.01)
*D05B 57/02* (2006.01)

(52) U.S. Cl.
CPC ..... *D05B 49/02* (2013.01); *D05B 49/04* (2013.01); *D05B 57/02* (2013.01)

(58) Field of Classification Search
CPC .. D05B 49/00–06; D05B 57/02; D05B 57/00; D05B 57/04
See application file for complete search history.

(56) References Cited

U.S. PATENT DOCUMENTS

| | | | | | |
|---|---|---|---|---|---|
| 2,760,457 | A * | 8/1956 | Rabezzana | D05B 69/32 | 112/221 |
| 3,168,066 | A * | 2/1965 | Hedegaard | D05B 69/22 | 192/148 |
| 4,215,641 | A * | 8/1980 | Dobrjanskyj | D05B 49/02 | 112/278 |
| 4,660,482 | A * | 4/1987 | Skogward | D05B 49/02 | 74/54 |
| 4,688,501 | A * | 8/1987 | Mikuni | D05B 49/02 | 112/254 |
| 4,907,517 | A * | 3/1990 | Hanyu | D05B 49/02 | 112/254 |
| 7,111,568 | B1 * | 9/2006 | Sakuma | D05B 1/10 | 112/200 |

FOREIGN PATENT DOCUMENTS

| | | | | |
|---|---|---|---|---|
| DE | 19825784 | A1 * | 12/1999 | D05B 49/02 |
| JP | H08-80392 | A | 3/1996 | |
| JP | 3350432 | B | 11/2002 | |
| JP | 2009-195449 | A | 9/2009 | |

* cited by examiner

*Primary Examiner* — Ismael Izaguirre
(74) *Attorney, Agent, or Firm* — Yokoi & Co., U.S.A.; Toshiyuki Yokoi

(57) ABSTRACT

A thread take-up lever switching mechanism can switch the operation of a thread take-up lever which is interlocked with an upper shaft. The thread take-up lever switching mechanism includes: a cylindrical cam provided on the upper shaft, the cylindrical cam having a plurality of cam surfaces; a contact portion provided on the thread take-up lever, the contact portion contacting a first surface of the plurality of cam surfaces; and a switch for switching the contact portion from a first position of contacting the first surface of the plurality of cam surfaces to a second position of contacting a second surface of the plurality of cam surfaces.

5 Claims, 6 Drawing Sheets

THREAD TAKE-UP LEVER SWITCHING MECHANISM AND SEWING MACHINE

CROSS-REFERENCES TO RELATED APPLICATIONS

This patent specification is based on Japanese patent application, No. 2021-081899 filed on May 13, 2021 in the Japan Patent Office, the entire contents of which are incorporated by reference herein.

BACKGROUND OF THE INVENTION

1. Field of the Invention

The present intention relates to a thread take-up lever switching mechanism provided on a double chain stitch sewing machine and a sewing machine having the thread take-up lever switching mechanism.

2. Description of the Related Art

Conventionally, a sewing machine capable of performing a double chain stitch (multi thread chain stitch) defined as indication signs 406, 407 and the like in JIS-L0120 is known. As shown in FIG. 4 to FIG. 6, the above described sewing machine includes needles (three needles of first needle 4, second needle 5 and third needle 6 in the illustrated example), a looper 7, a thread take-up lever and a feed mechanism (not-illustrated). A first needle thread T1, a second needle thread T2 and a third needle thread T3 are inserted into needle holes of the first needle 4, the second needle 5 and the third needle 6 respectively. The looper 7 is provided at a position capable of capturing a looper thread T4. The above described members cooperate with each other for forming double chain stitch on a sewing object (not-illustrated) such as a cloth (fabric). Note that the illustrated double chain stitch shows the seam (stitch) of the indication sign 407.

Here, the method of forming the seam of the double chain stitch will be explained with reference to the drawings. First, in FIG. 4A, it is supposed that the first needle 4 and the like to be located at the lowermost position and the looper 7 are located at the rightmost position. Then, as shown in FIG. 4B, the first needle 4 and the like are raised and loops are formed on the first needle thread T1 and the like. The looper 7 is moved leftward and a tip portion of the looper 7 enters in the loops.

Then, as shown in FIG. 5A, the looper 7 captures all of the loops and the first needle 4 and the like are further raised. At this time, the first needle thread T1 and the like are tightened by a not-illustrated thread take-up lever. Then, as shown in FIG. 5B, the first needle 4 and the like are raised to the uppermost point and the looper 7 is moved to the leftmost point while capturing the looper thread T4. In addition, the cloth is moved from the rear to the front by a not-illustrated feed mechanism. Thus, the seam is moved frontward by a predetermined amount (distance) as a whole.

After that, as shown in FIG. 6A, the looper 7 is moved to the right. At this time, the first needle 4 and the like are lowered while scooping the looper thread T4. Thus, the first needle thread T1 and the like are crossed with the looper thread T4. After that, as shown in FIG. 6B, the looper 7 is moved to the right and then to the front. Accordingly, the entanglement between the looper 7 and the first needle thread T1 is released. On the other hand, since the first needle 4 and the like are lowered while scooping the looper thread T4, new seams are formed.

After that, the double chain stitch is performed by repeating the step shown in FIG. 4A and the following steps.

When the double chain stitch is performed, the thread path (route of thread) of the needle threads significantly varies in each stage of forming the seam depending on the vertical movement (motion) of the needles and the reciprocating movement (motion) of the looper. In order to absorb the above described variation, the thread take-up lever is vertically moved in accordance with the vertical movement of the needle. Specifically, the thread is supplied to the needles by lowering the thread take-up lever, and the thread supplied to the needles is collected and tightened by raising the thread take-up lever. Namely, the seams can be stably formed by supplying and collecting the needle thread by the thread take-up lever in accordance with the stage of forming the seam.

Note that the kind of the cloth to be sewn and the number of the cloths to be layered vary depending on the object to be produced. Namely, since the thickness varies depending on the sewing object, the thread path of the needle threads varies depending on the thickness. Accordingly, if the supply amount of the needle threads can be optimized in accordance with the thickness of the sewing object, the seams can be stably and suitably formed.

For example, Patent Document 1 is known as the conventional technology of focusing the above described point. In Patent Document 1, a switching mechanism capable of changing the phase (operation timing) and the vertical stroke of the thread take-up lever in accordance with the thickness of the sewing object by using an eccentric pin mechanism in a lock stitch sewing machine.

[Patent Document 1] Japanese Unexamined Patent Application Publication No. 2009-195449

BRIEF SUMMARY OF THE INVENTION

As described above, a link for driving the thread take-up lever is changed by the eccentric pin mechanism in Patent Document 1. Namely, in order to perform the adjustment in accordance with the thickness of the sewing object, both the phase and the vertical stroke of the thread take-up lever are changed simultaneously. Therefore, even if the technology of the lock stitch sewing machine of Patent Document 1 is applied to a double chain stitch sewing machine, there is a problem that both the phase and the vertical stroke of the thread take-up lever are changed simultaneously similar to Patent Document 1. Thus, it is difficult to perform the adjustment optimally in accordance with the thickness of the sewing object. In addition, it is difficult in the technology of Patent Document 1 to change a part of the operation process. For example, it is difficult to advance (accelerate) the timing of the operation of the thread take-up lever compared to the conventional technology only in a certain stage of the process of forming the seam.

The present invention provides a thread take-up lever switching mechanism capable of changing only a part of the operation process of forming the seam and performing the adjustment optimally in accordance with the thickness of the sewing object and a sewing machine provided with the thread take-up lever switching mechanism.

The present invention is a thread take-up lever switching mechanism provided on a double chain stitch sewing machine for changing an operation of a thread take-up lever which is interlocked with an upper shaft, the thread take-up lever switching mechanism having: a cylindrical cam provided on the upper shaft, the cylindrical cam having a plurality of cam surfaces; a contact portion provided on the thread take-up lever, the contact portion contacting a first surface of the plurality of cam surfaces; and a switch for switching the contact portion from a first position of contacting the first surface of the plurality of cam surfaces to a second position of contacting a second surface of the plurality of cam surfaces.

In the above described thread take-up lever switching mechanism, it is preferred that the first surface of the plurality of cam surfaces is specified to advance a timing of lowering the thread take-up lever from an uppermost position compared to the second surface of the plurality of cam surfaces.

In the above described thread take-up lever switching mechanism, it is preferred that the first surface of the plurality of cam surfaces is specified to make the uppermost position of the thread take-up lever higher compared to the second surface of the plurality of cam surfaces.

In the above described thread take-up lever switching mechanism, it is preferred that the thread take-up lever is configured to rock around a fulcrum portion for vertically moving a thread retainer, the contact portion is located below the cylindrical cam when the fulcrum portion is located between the thread retainer and the contact portion, and the contact portion is located above the cylindrical cam when the contact portion is located between the thread retainer and the fulcrum portion.

In addition, the present invention is a sewing machine having any one of the above described thread take-up lever switching mechanisms.

In the thread take-up lever switching mechanism of the present invention, the cylindrical cam having the plurality of cam surfaces is provided on the upper shaft, and the contact portion contacting one of the cam surfaces is provided on the thread take-up lever. The contact portion is switched from a first position of contacting the first surface of the plurality of cam surfaces to a second position of contacting a second surface of the plurality of cam surfaces by using the switch. Namely, an optimal cam surface can be selected from the plurality of cam surfaces by operating the switch for driving the thread take-up lever in accordance with the thickness of the sewing object. In addition, only a part of the operation process of forming the seam can be changed by changing the shape of the cam surface.

DETAILED DESCRIPTION OF THE INVENTION

Hereafter, an embodiment of a sewing machine of the present invention will be explained with reference to the drawings. In the following explanation, the explanation will be made using the directions of right, left, front, rear, up, down, X, Y and Z for convenience.

Figure 1:
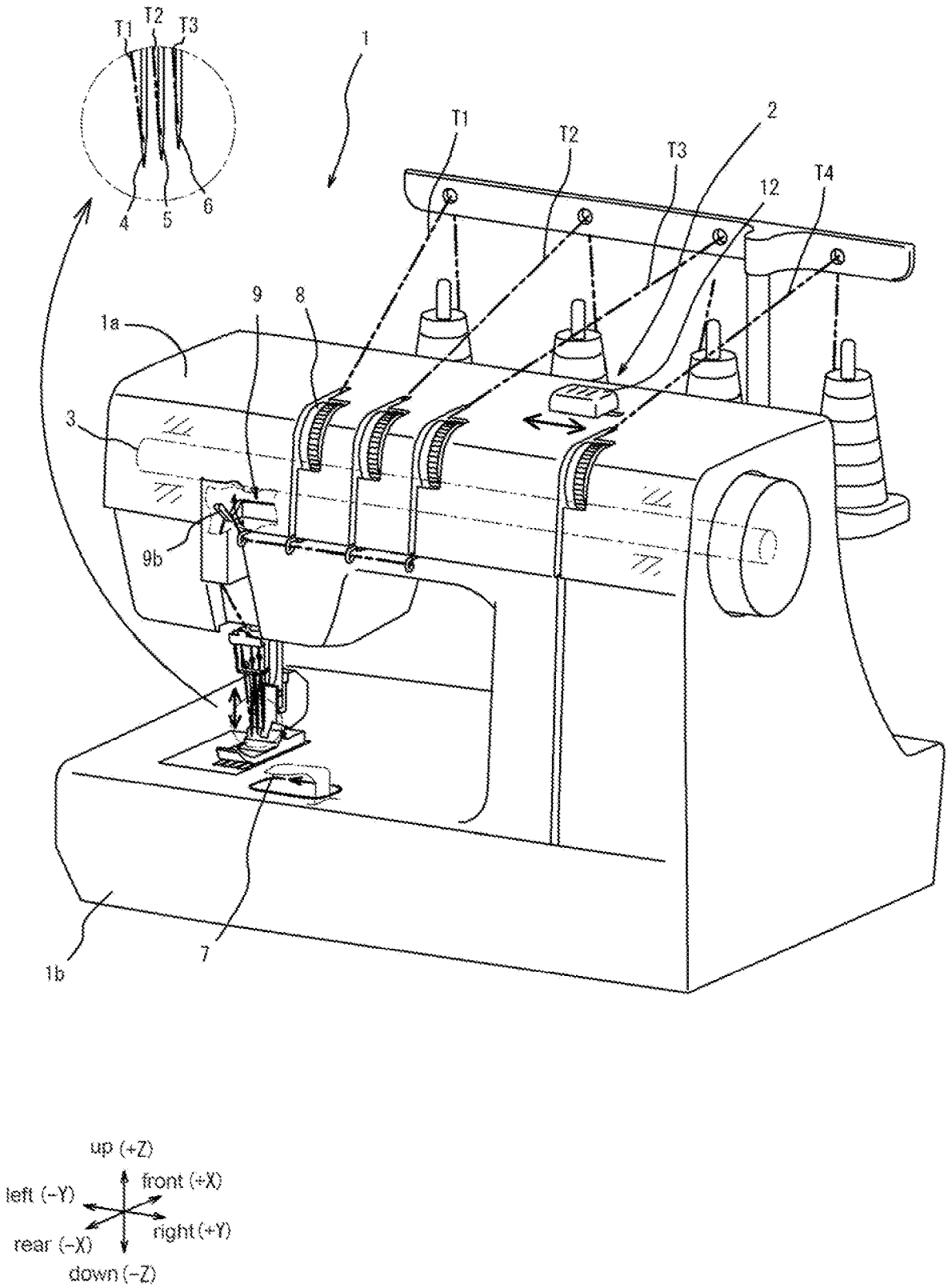
FIG. 1 is a perspective view showing an embodiment of a sewing machine concerning the present invention.

FIG. 1 shows a sewing machine 1 realizing a sewing machine of the present invention.

A thread take-up lever switching mechanism 2 (shown in FIG. 2) including a later described switch 12 is mounted on the sewing machine 1. An arm portion 1*a* of the sewing machine 1 is provided with an upper shaft 3 rotated by a not-illustrated sewing machine motor, and a bed portion 1*b* is provided with a not-illustrated lower shaft rotated by the sewing machine motor. The upper shaft 3 is connected with needles (comprised of three needles: the first needle 4; the second needle 5; and third needle 6 in the present embodiment) and the thread take-up lever 9. The lower shaft is connected with the looper 7 and a feed mechanism (not illustrated). In addition, the first needle thread T1, the second needle thread T2, the third needle thread T3 and the looper thread T4 wound around thread reels are attached to the sewing machine 1. The first needle thread T1, the second needle thread T2 and the third needle thread T3 are inserted into needle holes of the first needle 4, the second needle 5 and the third needle 6 respectively via a thread tensioner 8, the thread take-up lever 9 and the like. In addition, the looper thread T4 passes through the thread tensioner 8 and is held at a position capable of being captured by the looper 7. The sewing machine motor is rotated and the elements connected to the upper shaft 3 and the lower shaft are cooperated with each other. Thus, the double chain stitch shown in FIG. 4A to FIG. 6B can be performed.

Figure 6A:
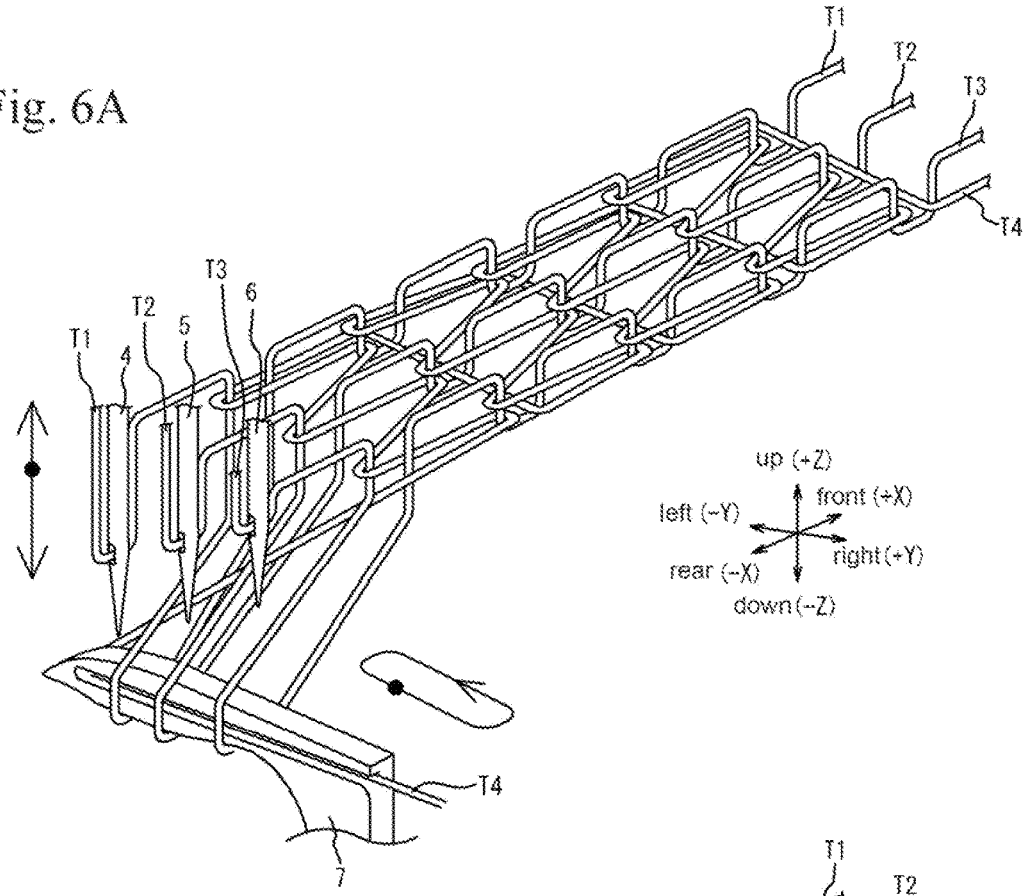
FIGS. 6A and 6B are explanation drawings related to the processes performed after the processes shown in FIGS. 5A and 5B.
Figure 6B:
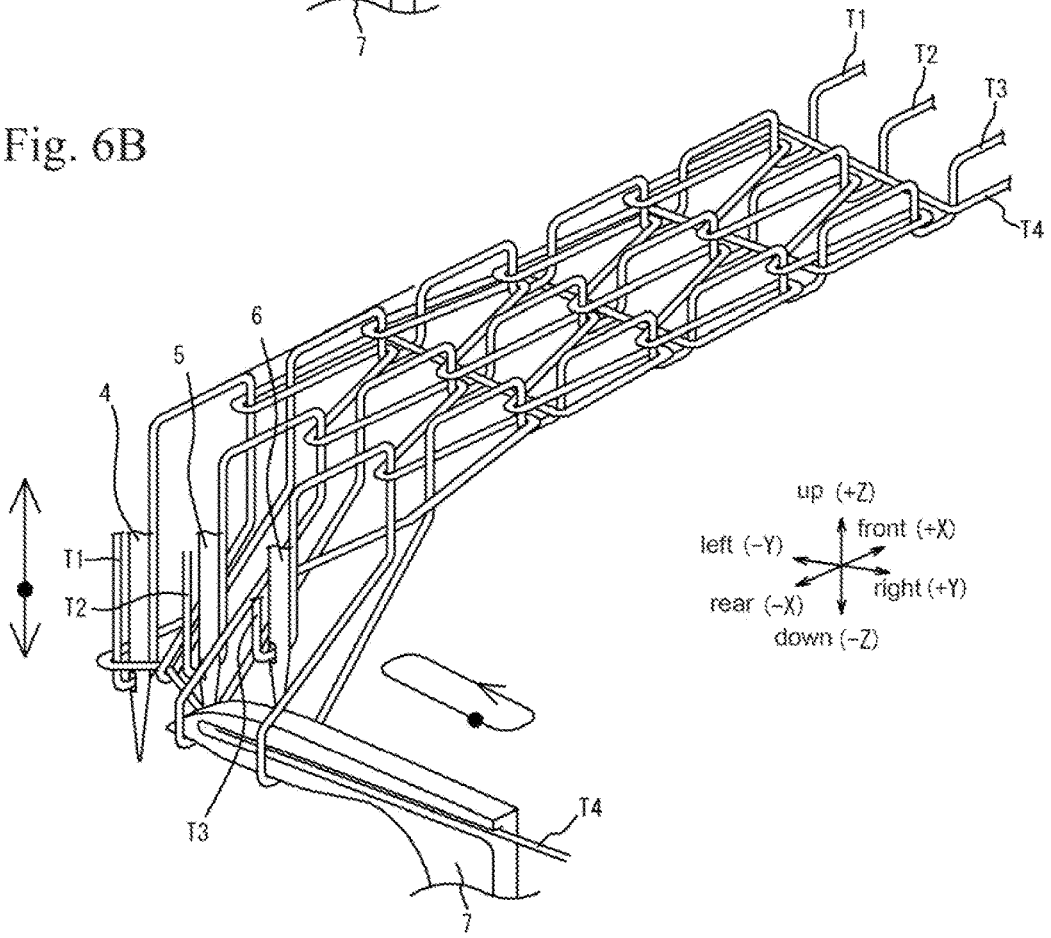

Before explaining the details of the sewing machine 1 and the thread take-up lever switching mechanism 2 of the present embodiment, the result of the study of the double chain stitch made by the inventor of the present invention will be explained. The inventor of the present invention repeatedly studied the double chain stitch shown in FIG. 4A to FIG. 6B. As a result, it is found that inflated seams can be obtained while suppressing sewing shrinkage by advancing the phase of supplying the needle threads supplied by the thread take-up lever 9 compared to the operation of the conventional double chain stitch (advancing the timing of lowering the thread take-up lever 9 from an uppermost position compared to the conventional operation) when sewing thin cloth. Since the mechanism of the sewing in the double chain stitch is extremely complicated, the inventor of the present invention has not yet grasped the action precisely. However, it is assumed that the inflated seams can be obtained since the thread take-up lever 9 feeds the first needle thread T1 and the like to the first needle 4 and the like quickly in the timing of lowering the first needle 4, the second needle 5 and the third needle 6 and forming new seam (the timing where the first needle thread T1, the second needle thread T2 and the third needle thread T3 captured by the looper 7 are released from the looper 7) shown in FIG. 6B. Because of this, the amount of the needle threads in the initially formed seam is increased and a part of the increased threads remains after the threads are tightened. Note that FIG. 6B shows the state that the angle of the upper shaft 3 is rotated to 300° in condition that the angle of the upper shaft 3 is specified as 0° where the first needle 4 and the like are located at the lowermost position (state shown in FIG. 4A). On the other hand, when the thread take-up lever 9 is raised, a part of the supplied first needle thread T1 and the like is collected and the seam is tightened. If this timing is also advanced, excessive tension is applied to the first needle thread T1 and the like. This may cause the trouble of breaking the first needle thread T1 and the like. Accordingly, it is preferable that the timing of raising the thread take-up lever 9 is not changed regardless of the thickness of the sewing object.

When the double chain stitch is performed, the looper 7 moves in the front, rear, left and right directions with respect to the cloth (i.e., sewing object) but does not move in the up and down directions. Namely, the amount of using the looper thread T4 is basically not changed even when the thickness of the cloth to be sewn is changed. On the other hand, the first needle 4, the second needle 5 and the third needle 6 move in the vertical direction with respect to the cloth to be sewn while the first needle thread T1, the second needle thread T2 and the third needle thread T3 are inserted into the needle holes. Thus, the amount of using the first needle thread T1 and the like varies depending on the thickness of the cloth to be sewn. Accordingly, when thick cloth is sewn, it is effective to increase the amount of the thread supplied by the thread take-up lever 9. In other words, it is effective to increase the stroke amount of the thread take-up lever 9.

Figure 2:
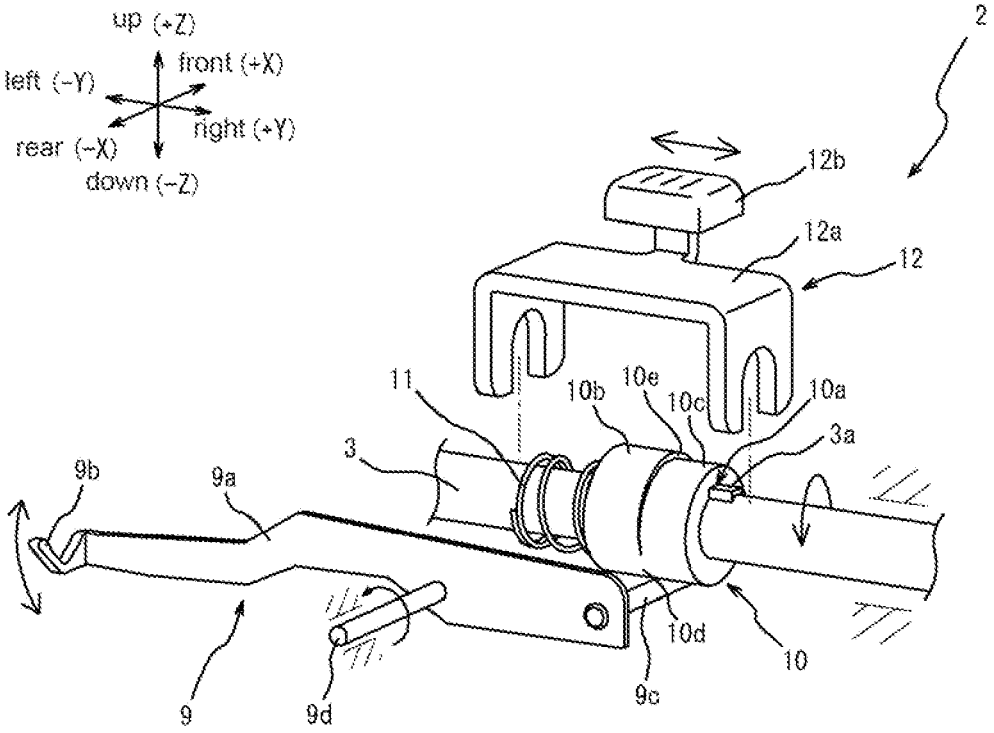
FIG. 2 is an explanation drawing related to a thread take-up lever switching mechanism shown in FIG. 1.

The thread take-up lever switching mechanism 2 shown in FIG. 2 is configured based on the above described knowledge. The thread take-up lever switching mechanism 2 of the present embodiment is composed of a thread take-up lever 9, a cylindrical cam 10, a compression spring 11 and a switch 12. However, as described above, the compression spring 11 is not necessary.

The thread take-up lever 9 includes a body portion 9*a* having a plate shape. A thread retainer 9*b* having a V-shape protruded from the front to the rear is provided on one end (left end) of the body portion 9*a*. As shown in FIG. 1, the first needle thread T1, the second needle thread T2 and the third needle thread T3 are laid on the thread retainer 9*b* to support these threads from the below. In addition, a contact portion 9*c* having a cylindrical shape protruded from the rear to the front is provided on one end of the body portion 9*a*. The contact portion 9*c* is configured to be in contact with a later described left cam surface 10*b* or right cam surface 10*c* of the cylindrical cam 10. A fulcrum portion 9*d* having a cylindrical shape protruded from the front to the rear is provided on an intermediate portion (portion between the thread retainer 9*b* and the contact portion 9*c*) of the body portion 9*a*. The fulcrum portion 9*d* is rotatably supported by a not-illustrated sewing machine frame. Thus, the body portion 9*a* is rocked (swung) so that the thread retainer 9*b* moves in the vertical direction around the fulcrum portion 9*d*. Although the illustration is omitted, the thread take-up lever 9 is energized by a not-illustrated spring in the direction of an arrow in the drawing (counterclockwise direction in the view from the rear to the front).

The cylindrical cam 10 is attached to the upper shaft 3 so as to be not rotatable in the circumferential direction but slidable in the axial direction with respect to the upper shaft 3. As the above described mechanism, in the present embodiment, a key is provided on the upper shaft 3, and an opening 10*a* is provided on the cylindrical cam 10. The opening 10*a* includes a circular portion to which the upper shaft 3 is inserted and a rectangular portion to which the key 3*a* is inserted. In addition, two cam surfaces (left cam surface 10*b* and right cam surface 10*c*) are provided on an outer peripheral surface of the cylindrical cam 10. Note that a cam profile of the left cam surface 10*b* and a cam profile of the right cam surface 10*c* are partly same although they are partly different. Here, a portion where the cam profile is same between the left cam surface 10*b* and the right cam surface 10*c* and the outer peripheral surfaces are completely matched with each other without forming a step in the axial direction is referred to as a stepless portion 10*d*. On the other hand, a portion where the cam profile is different and the outer peripheral surfaces are displaced between the left cam surface 10*b* and the right cam surface 10*c* forming a step in the axial direction is referred to as a stepped portion 10*e*. In the present embodiment, since the cam lift amount of the left cam surface 10*b* is larger than the cam lift amount of the right cam surface 10*c*, the stepped portion 10*e* is provided and directed so that the left cam surface 10*b* is protruded outward in the radial direction than the right cam surface 10*c*.

In the present embodiment, the compression spring 11 is inserted around the upper shaft 3 so that the compression spring 11 is located at the left side of the cylindrical cam 10 to energize the cylindrical cam 10 from the left to the right.

The switch 12 includes a slide plate 12*a* which extends in the left-right direction wherein the left end portion and the right end portion of slide plate 12*a* are extended downward. The left end portion and the right end portion of the slide plate 12*a* are formed in an inverted U-shape as shown in the drawing. As shown in FIG. 1, a switching lever 12*b* which is exposed from a housing of the sewing machine 1 is provided on the upper part of the slide plate 12*a*. As shown in FIG. 2, the switch 12 is attached to sandwich the cylindrical cam 10 and the compression spring 11 which are mounted on the upper shaft 3 by the left end portion and the right end portion.

As shown in FIG. 1, in the above described thread take-up lever switching mechanism 2, the first needle thread T1, the second needle thread T2 and the third needle thread T3 are laid on the thread retainer 9*b* of the thread take-up lever 9, and the force of rotating the thread take-up lever 9 is acted on the thread take-up lever 9 in the direction of the arrow shown in FIG. 2 (counterclockwise direction in the view from the rear to the front) when the tensional force of the first needle thread T1 and the like is applied. Here, the contact portion 9*c* of the present embodiment is located below the cylindrical cam 10 and in contact with the cylindrical cam 10 from the below. Namely, since the cylindrical cam 10 is provided on the upper shaft 3 having high rigidity, the tensional force of the first needle thread T1 and the like can be received with a margin.

In the thread take-up lever switching mechanism 2 of the present embodiment, the contact portion 9*c* is in contact with the right cam surface 10*c* in a state that the switch 12 is moved to the left. Namely, in the above described state, the thread retainer 9*b* is operated in accordance with the cam profile of the right cam surface 10*c* by the contact portion 9*c* which is in contact with the right cam surface 10*c*. When the switch 12 is moved to the right, since the cylindrical cam 10 is moved to the right by the energization force of the compression spring 11, the contact portion 9*c* is in contact with the left cam surface 10*b*. Namely, in the above described state, the thread retainer 9*b* is operated in accordance with the cam profile of the left cam surface 10*b*. Accordingly, when the profile suitable for sewing thin cloth is employed for the right cam surface 10*c* while the profile suitable for sewing thick cloth is employed for the left cam surface 10*b*, for example, the sewing can be performed in the optimum condition in accordance with the sewing object by moving the switch 12.

In a state that the contact portion 9*c* is in contact with the right cam surface 10*c*, if the switch 12 is moved to the right, the contact portion 9*c* collides with the stepped portion 10*e*. However, the cylindrical cam 10 is attached to the upper shaft 3 so as to be slidable in the axial direction and energized by the compression spring 11. Thus, when the switch 12 is moved to the right in this state, the compression spring 11 is compressed to absorb an impact generated when the stepped portion 10*e* collides with the contact portion 9*c*. In addition, the cylindrical cam 10 is also rotated when the upper shaft 3 is rotated. Because of this, the contact portion 9*c* contacted at the stepped portion 10*e* is then gradually contacted at the stepless portion 10*d*. At this timing, the cylindrical cam 10 is automatically moved to the right by the energization force of the compression spring 11. Namely, in order to form a plurality of cam profiles on the cylindrical cam 10, the stepped portion 10*e* may be provided by the cam lift amount. However, since the configuration of the present embodiment is employed, faults occurred during the switching operation can be prevented.

Figure 3:
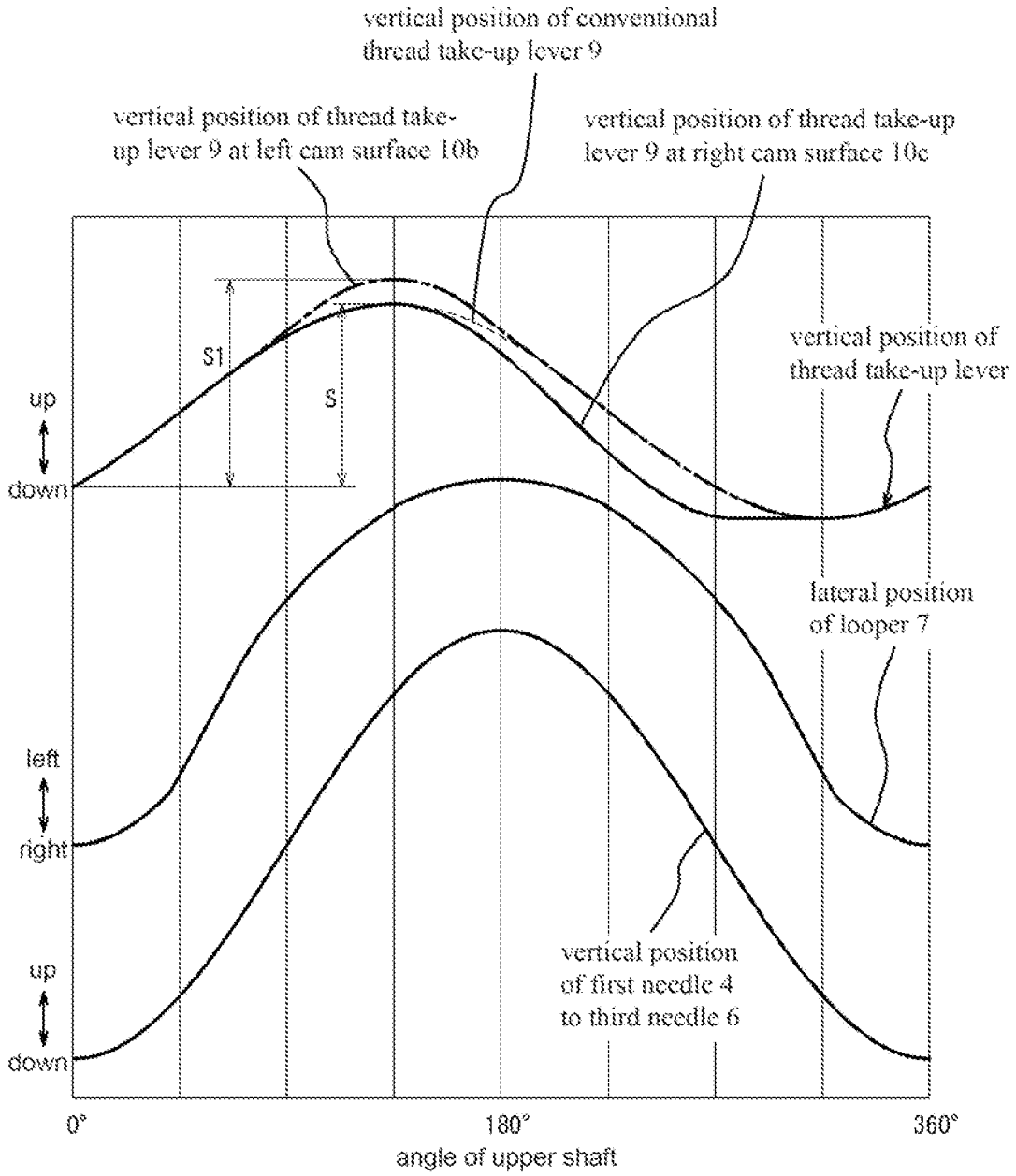
FIG. 3 is an operational diagram related to a thread take-up lever, a looper and needles shown in the sewing machine shown in FIG. 1.
Figure 4A:
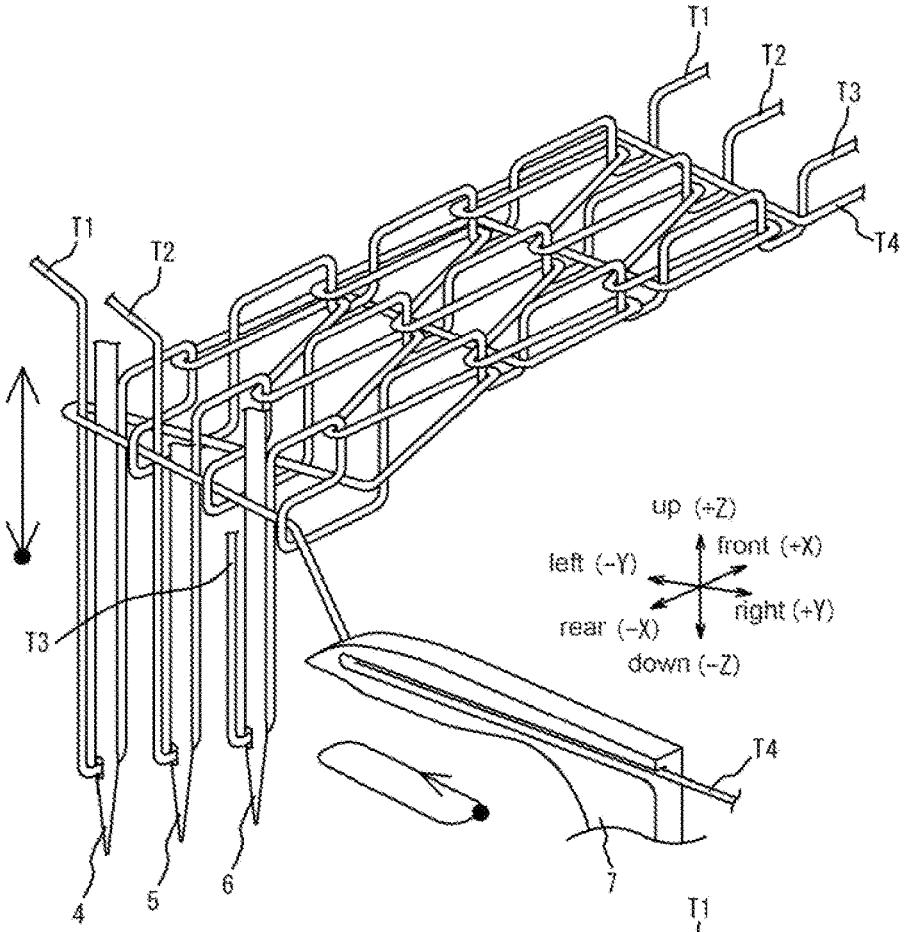
FIGS. 4A and 4B are explanation drawings related to the double chain stitch performed by the sewing machine shown in FIG. 1.
Figure 4B:
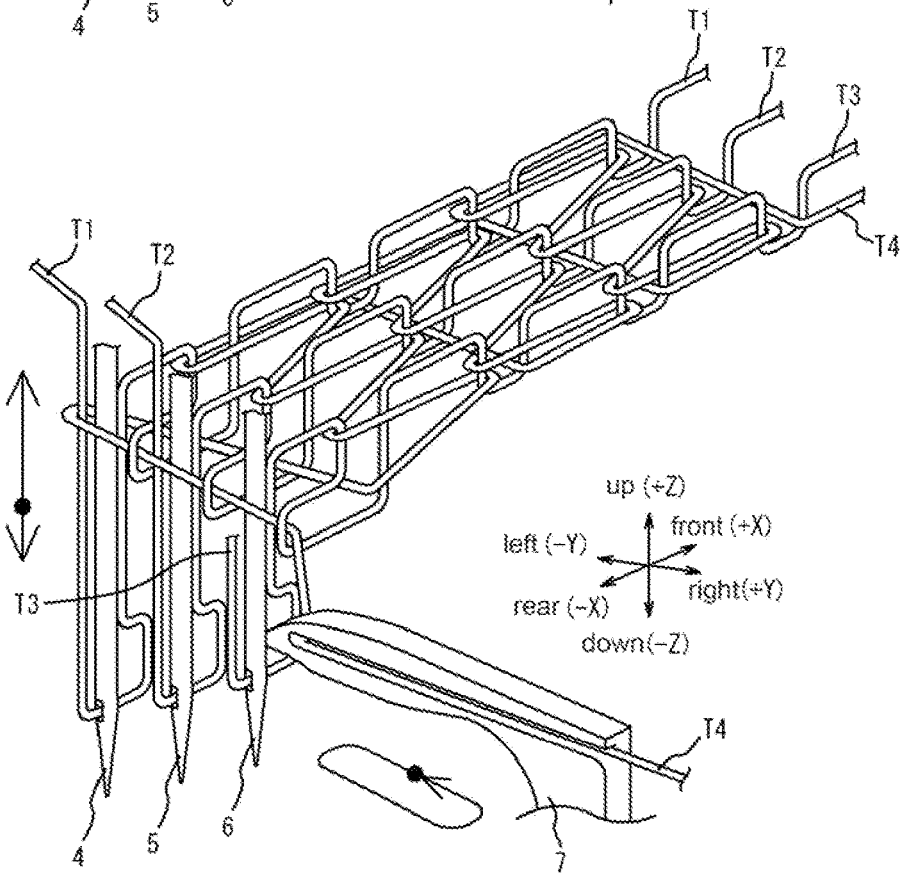
Figure 5A:
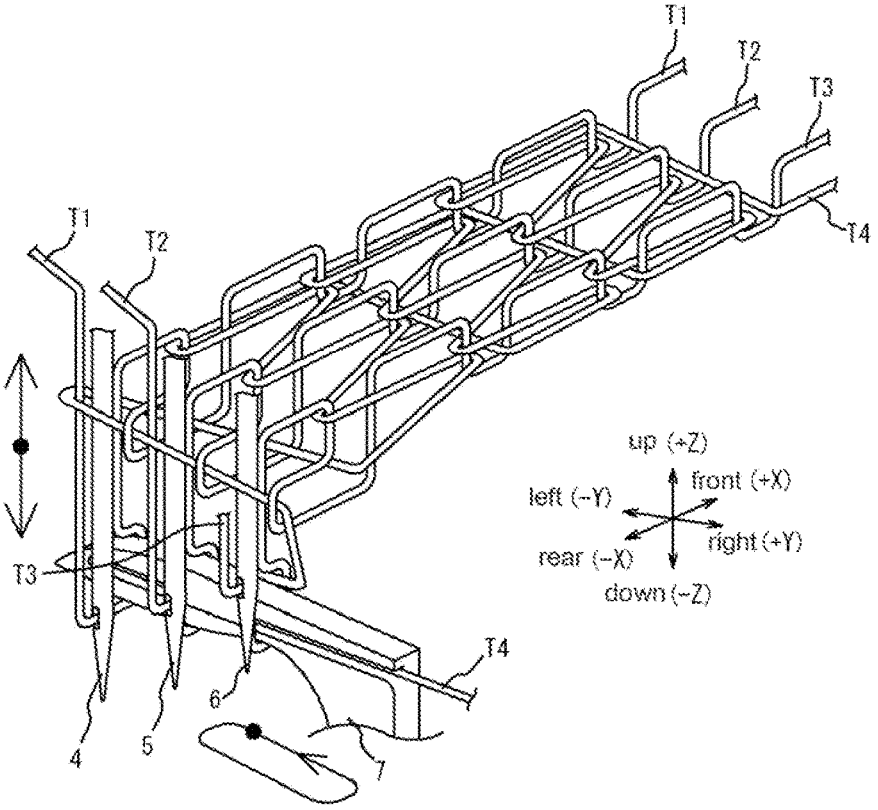
FIGS. 5A and 5B are explanation drawings related to the processes performed after the processes shown in FIGS. 4A and 4B.
Figure 5B:
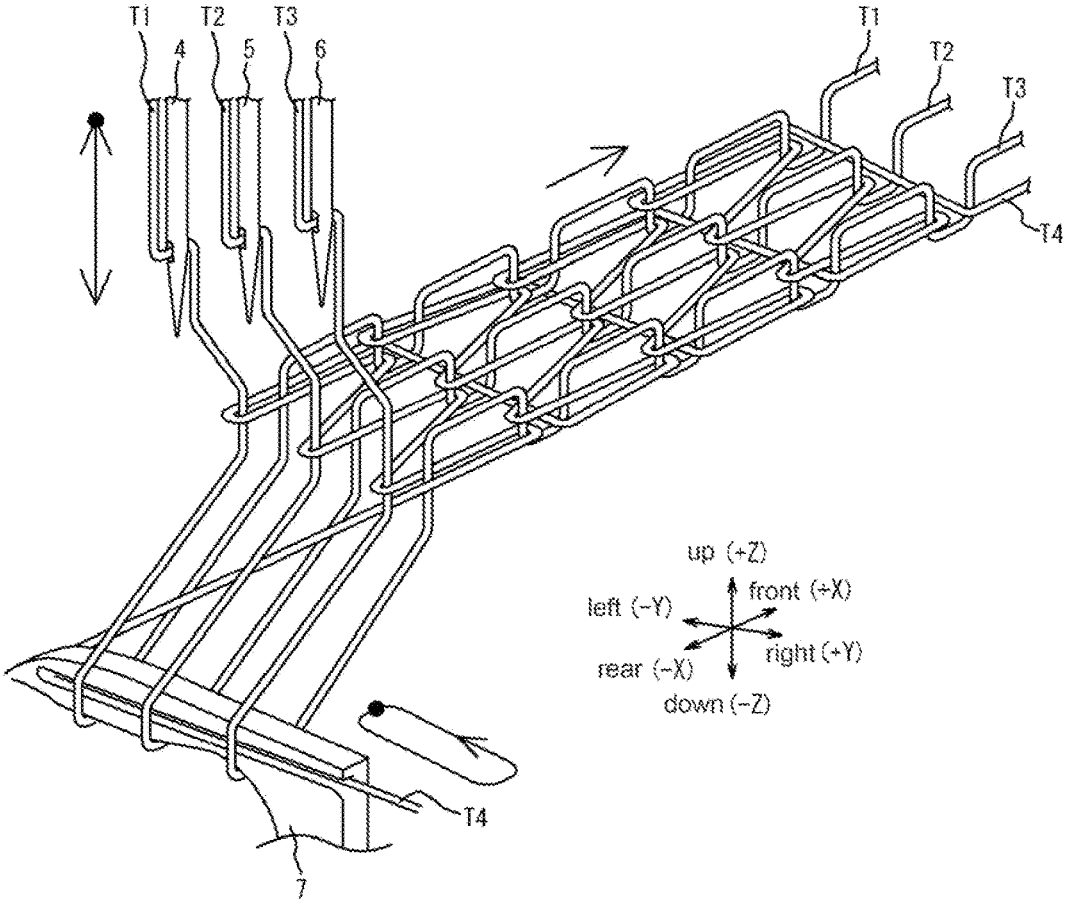

Here, regarding the left cam surface 10*b* and the right cam surface 10*c* of the present embodiment, the operation of the thread retainer 9*b* in a state that the contact portion 9*c* is in contact with the left cam surface 10*b* and the operation of the thread retainer 9*b* in a state that the contact portion 9*c* is in contact with the right cam surface 10*c* will be explained with reference to the operational diagram of FIG. 3. As described above, when the sewing machine motor is rotated, the upper shaft 3 and the lower shaft are rotated accordingly. Thus, the first needle 4, the second needle 5, the third needle 6 and the thread take-up lever 9 connected with the upper shaft 3 and the looper 7 and the feed mechanism connected with the lower shaft are moved in a predetermined timing and at a predetermined stroke as shown in the operational diagram of FIG. 3. In the operation diagram of the vertical position of the thread take-up lever shown in FIG. 3, the broken line shows the vertical position of the thread retainer 9*b* in the conventional double chain stitch. The dash dotted line shows the vertical position of the thread retainer 9*b* in a state that the contact portion 9*c* is in contact with the left cam surface 10*b*. The solid line shows the vertical position of the thread retainer 9*b* in a state that the contact portion 9*c* is in contact with the right cam surface 10*c*.

As described above, according to the study of the inventor of the present invention, it is found that it is preferable to advance the phase of supplying the needle threads supplied by the thread retainer 9*b* when the double chain stitch is performed on thin sewing object. In addition, it is preferable that the timing of raising the thread retainer 9*b* is not changed depending on the thickness of the sewing object. In the present embodiment, the profile suitable for sewing thin cloth is employed for the right cam surface 10*c*. Thus, when the switch 12 is moved to the left, the thread retainer 9*b* is operated along the solid line in the vertical position of the thread take-up lever shown in FIG. 3. Namely, only the timing of lowering the thread retainer 9*b* is advanced compared to the conventional double chain stitch shown by the broken line in FIG. 3. Accordingly, thin sewing object can be suitably sewn in this case.

On the other hand, as described above, when the double chain stitch is performed on thick sewing object, it is preferable that the stroke amount of the thread retainer 9*b* is increased compared to the conventional stroke amount while the timing of raising the thread retainer 9*b* is not changed. In the present embodiment, the profile suitable for sewing thick cloth is employed for the left cam surface 10*b*. Thus, when the switch 12 is moved to the right, the thread retainer 9*b* is operated along the dash dotted line in the vertical position of the thread take-up lever shown in FIG. 3. Namely, only the stroke amount S1 of the thread retainer 9*b* is increased compared to the stroke amount S of the conventional double chain stitch shown by the broken line in FIG. 3. Accordingly, thick sewing object can be suitably sewn in this case.

The embodiment embodying the present invention is exemplified above. However, the present invention is not limited to the above described specific embodiment. Various variations and modifications are possible within the content of the present invention described in the claims unless particularly limited in the above described explanation. In addition, the above described effects of the embodiment merely exemplify the effects raised from the present invention. The effects of the present invention are not limited to the above described effects.

For example, the thread take-up lever switching mechanism 2 of the present embodiment is provided with the compression spring 11 for preventing the collision between the contact portion 9*c* and the stepped portion 10*e* during the switching operation. However, the compression spring 11 can be omitted by using other collision preventing means. For example, the compression spring 11 can be omitted by gently forming the stepped portion 10*e* (i.e., tilting the stepped portion 10*e*).

For example, the fulcrum portion 9*d* of the thread take-up lever 9 of the present embodiment is provided on the intermediate portion of the body portion 9*a* (portion between the thread retainer 9*b* and the contact portion 9*c*). However, it is also possible to provide the fulcrum portion 9*d* on the reverse end of the body portion 9*a* compared to the portion where the thread retainer 9*b* is provided. In that case, the contact portion 9*c* is provided on the intermediate portion of the body portion 9*a* (the contact portion 9*c* is provided between the thread retainer 9*b* and the fulcrum portion 9*d*). In the above described case, considering the tensional force of the first needle thread T1 and the like acting on the thread retainer 9*b*, the contact portion 9*c* is preferably configured to be positioned above the cylindrical cam 10.

In addition, the cylindrical cam 10 of the present embodiment has two cam surfaces of the left cam surface 10*b* and the right cam surface 10*c*. However, it is also possible to form three or more cam surfaces. In the present embodiment, the cam lift amount of the left cam surface 10*b* is configured to be larger than the cam lift amount of the right cam surface 10*c*. However, it is also possible to make the cam lift amount of the right cam surface 10*c* larger. When the cam lift amount of the right cam surface 10*c* is larger, considering the stepped portion 10*e*, it is preferable that the compression spring 11 is configured to be located at the right of the cylindrical cam 10.

Note that, this invention is not limited to the above-mentioned embodiments. Although it is to those skilled in the art, the following are disclosed as the one embodiment of this invention.

- Mutually substitutable members, configurations, etc. disclosed in the embodiment can be used with their combination altered appropriately.
- Although not disclosed in the embodiment, members, configurations, etc. that belong to the known technology and can be substituted with the members, the configurations, etc. disclosed in the embodiment can be appropriately substituted or are used by altering their combination.
- Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A thread take-up lever switching mechanism provided on a double chain stitch sewing machine for changing an operation of a thread take-up lever which is interlocked with an upper shaft, the thread take-up lever switching mechanism comprising:

a cylindrical cam provided on the upper shaft, the cylindrical cam having a plurality of cam surfaces;

a contact portion provided on the thread take-up lever, the contact portion contacting a first surface of the plurality of cam surfaces; and a switch for switching the contact portion from a first position of contacting the first surface of the plurality of cam surfaces to a second position of contacting a second surface of the plurality of cam surfaces, wherein when an axial direction of the upper shaft is a left-right direction, a longitudinal direction the thread take-up lever is arranged in the left-right direction and the contact portion is protruded in a front-rear direction from the thread take-up lever.

2. The thread take-up lever switching mechanism according to claim 1, wherein the first surface of the plurality of cam surfaces is specified to advance a timing of lowering the thread take-up lever from an uppermost position compared to the second surface of the plurality of cam surfaces.

3. The thread take-up lever switching mechanism according to claim 1, wherein the first surface of the plurality of cam surfaces is specified to make the uppermost position of the thread take-up lever higher compared to the second surface of the plurality of cam surfaces.

4. The thread take-up lever switching mechanism according to claim 1, wherein the thread take-up lever is configured to rock around a fulcrum portion for vertically moving a thread retainer, the fulcrum portion is located between the thread retainer and the contact portion, and the contact portion is located below the cylindrical cam.

5. A sewing machine including the thread take-up lever switching mechanism according to any one of claim 1.

* * * * *